US006286768B1

(12) United States Patent
Vetters et al.

(10) Patent No.: US 6,286,768 B1
(45) **Date of Patent: *Sep. 11, 2001**

(54) PINNED INJECTOR ASSEMBLY

(75) Inventors: Daniel K. Vetters, Columbus; Daniel K. Hickey, Greenwood; Bruce E. Varney, Columbus, all of IN (US)

(73) Assignee: Cummins Engine Company, Inc., Columbus, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/049,110

(22) Filed: Mar. 27, 1998

(51) Int. Cl.[7] ..... F02M 59/00
(52) U.S. Cl. ..... 239/533.2; 239/600
(58) Field of Search ..... 239/533.2–533.7, 239/88–92, 600; 285/305, 404, 382; 403/379.4, 379.5, 379.1, 378

(56) References Cited

U.S. PATENT DOCUMENTS

| | | | | |
|---|---|---|---|---|
| 2,772,898 | | 12/1956 | Seeler . | |
| 2,860,010 | * | 11/1958 | Sennstrom et al. | 239/533.7 |
| 3,339,848 | * | 9/1967 | Geiger | 239/90 |
| 3,384,308 | * | 5/1968 | Cupler, II | 239/600 |
| 3,973,791 | * | 8/1976 | Porta et al. | 285/305 |
| 4,034,917 | * | 7/1977 | Bailey | 239/533.7 |
| 4,431,218 | | 2/1984 | Paul, Jr. et al. . | |
| 4,467,772 | | 8/1984 | Williamson . | |
| 4,570,980 | | 2/1986 | Goward . | |
| 4,628,881 | | 12/1986 | Beck et al. . | |
| 4,715,538 | | 12/1987 | Lingnau . | |
| 4,811,975 | | 3/1989 | Paul, Jr. et al. . | |
| 5,094,215 | | 3/1992 | Gustafson . | |
| 5,255,945 | * | 10/1993 | Toon | 285/305 |
| 5,357,933 | | 10/1994 | Kasahara et al. . | |
| 5,441,027 | | 8/1995 | Buchanon et al. . | |
| 5,564,633 | * | 10/1996 | Hardy et al. | 239/600 |

FOREIGN PATENT DOCUMENTS

| | | |
|---|---|---|
| 2282298 | 3/1976 | (FR) . |
| 39-22012 | 8/1964 | (JP) . |

* cited by examiner

*Primary Examiner*—Andres Kashinikow
*Assistant Examiner*—Dinh Q. Nguyen
(74) *Attorney, Agent, or Firm*—Nixon Peabody LLP; Charles M. Leedom, Jr.; Tim L. Brackett, Jr.

(57) ABSTRACT

A unit fuel injector is provided which includes a threadless injector body attaching device for attaching an upper body section of the fuel injector to a lower body section while avoiding imparting a transverse load to the upper body section thereby minimizing bore distortion, plunger wear and the likelihood of injector failure. The threadless injector body attaching device includes a groove formed in the lower end of the upper body section and one or more apertures extending through the lower body section for positioning adjacent the groove. Also, one or more pins are provided for insertion into a respective aperture and connection to the lower body section. The groove and opposing aperture or apertures are sized to create a slip fit to avoid a contact force between the pin or pins and the upper body section. Upon assembly, the pin, aperture and groove create a relatively loose connection between the upper body section and the lower body section without transverse loads while utilizing the clamping load imparted by an injector mounting clamp to apply the necessary sealing load to the injector body to create a fluid seal between the upper and lower body sections.

15 Claims, 2 Drawing Sheets

PINNED INJECTOR ASSEMBLY

TECHNICAL FIELD

The present invention is directed to a unit fuel injector for internal combustion engines which minimizes nonaxial forces on the injector body thereby reducing injector plunger wear, scuffing and seizure.

BACKGROUND

Unit fuel injectors operated by cams, have long been used in compression ignition internal combustion engines for their accuracy and reliability. The unit injector, whether of the open or closed nozzle type, typically includes an injector body having injector orifices at one end and a cam driven injector plunger assembly mounted for reciprocal movement within a central bore formed the injector body. In a typical unit injector, fuel is metered into an injection chamber with the amount of fuel being controlled on a cycle by cycle basis. The plunger assembly reciprocates through an advancement stroke to pressurize the metered fuel and force the fuel through the injector orifices into an engine combustion chamber, and a retraction stroke to permit metering of injection and perhaps timing fluid for the next injection event.

One of the major challenges to unit injector designers is limiting injector plunger wear and failure. Injector plungers are sized to form a diametrical clearance between the outer surface of the plunger and the inner surface of the corresponding bore formed in the injector body. However, nonaxial forces acting on the injector body cause distortion of the injector body and thus the bore. As a result, the diametrical clearance between the plunger and bore is reduced causing undesirable plunger scuffing and wear, and possible seizure or failure of the plunger. One source of nonaxial or transverse forces on the injector body are threaded connections between an upper barrel of the injector body and a lower injector body assembly. Threaded connections inherently produce nonaxial or transverse forces in the injector body due to the angled surfaces of the threads.

For example, U.S. Pat. Nos. 4,467,772; 5,094,215; and 5,441,027 all disclose unit fuel injectors having an outer barrel threadably connected to a lower injector body assembly. The threaded connection is positioned axially along the injector directly radially adjacent a plunger bore. As a result, the threads inherently impart a transverse load to the injector body distorting the plunger bore and thus disadvantageously causing plunger wear and possibly failure.

Consequently, there is a need for a unit fuel injector having an improved connection between the injector body components which reduces nonaxial assembly forces thereby minimizing plunger wear.

SUMMARY OF THE INVENTION

It is an object of the present invention, therefore, to overcome the disadvantages of the prior art and to provide a unit fuel injector which reduces plunger wear.

Another object of the present invention is to provide a unit fuel injector which is inexpensive to manufacture and simple to assemble.

Yet another object of the present invention is to provide a unit fuel injector which permits the attachment of the upper and lower sections of the injector body, and subsequent mounting on an engine, while avoiding imparting transverse loads to the injector body.

Still another object of the present invention is to provide a unit fuel injector which avoids the use of a threaded connection between the upper barrel section of the injector body and the lower section of the body.

Yet another object of the present invention is to provide a unit fuel injector having a plunger bore wherein distortion of the plunger bore is minimized.

It is a further object of the present invention is to provide a unit fuel injector which allows the injector clamping load to create internal sealed engagement between the injector sections.

These and other objects of the present invention are achieved by providing a unit fuel injector for injecting fuel into the combustion chamber of an internal combustion engine, comprising an injector body including an upper body section, a central bore formed in the upper body section, a lower body section and an injection orifice formed in one end of the injector body to discharge fuel into the combustion chamber. The unit injector further includes a plunger assembly mounted in the central bore for reciprocal movement through advancement and retraction strokes. In addition, a threadless injector body attaching device is positioned at an interface between the upper body section and the lower body section for attaching the upper body section to the lower body section while avoiding imparting a transverse load to the upper body section. The threadless injector body attaching device is preferably positioned along a longitudinal axis of the injector body radially adjacent the central bore. In addition, the threadless injector body attaching device is preferably positioned at the interface on at least two opposite sides of the injector body. Moreover, the threadless injector body attaching device may include a pin aperture formed in one of the upper body section and the lower body section, and a pin positioned in the pin aperture. The threadless injector body attaching device may also include a groove formed in one of the upper body section and the lower body section wherein the pin is positioned in the groove. The groove and the pin aperture form a cavity having a peripheral extent and the pin includes a width less than the cavity peripheral extent to create a slip fit between the components and the pin. The groove may be in the form of an annular groove extending around one of the upper body section and the lower body section. Preferably, the groove is formed in an outer surface of the upper body section and positioned in a recess formed in an upper end of the lower body section. The pin aperture may be formed in the lower body section and positioned tangential to the annular groove. In a preferred embodiment, the threadless injector body attaching device includes a first pin aperture formed in one side of the lower body section, a second pin aperture formed on an opposite side of the lower body section, a first pin positioned in the first pin aperture and a second pin positioned in the second pin aperture.

A unit fuel injector assembly is also provided for injecting fuel into the combustion chamber of an internal combustion engine, comprising an injector body including an upper body section including a lower surface, a central bore formed in the upper body section, a lower body section including an upper surface positioned adjacent the lower surface of the upper body section and an injection orifice formed in one end of the injector body to discharge fuel into the combustion chamber. A plunger assembly is mounted in the central bore for reciprocal movement through the advancement and retraction strokes. Also in this assembly, an injector body attaching device is positioned at an interface between the upper body section and the lower body section for attaching the sections while avoiding imparting an axial sealing load between the upper and the lower body sections. Importantly, a sealing load applying device, including an injector clamp for securing the injector body to the engine, is mounted for abutment against the injector body for applying a sealing load to the injector body of sufficient magnitude necessary to create a fluid seal between the upper surface of the lower body section and the lower surface of the upper body section.

DETAILED DESCRIPTION OF THE PREFERRED EMBODIMENT

Figure 1:
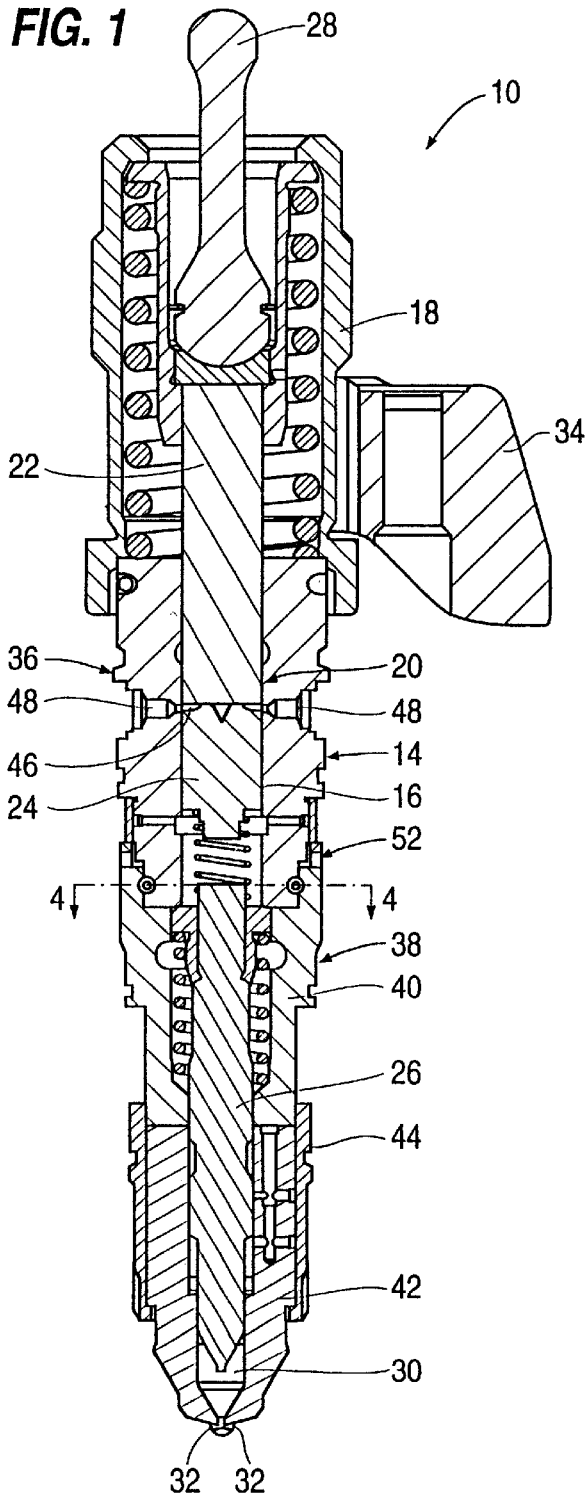
FIG. 1 is a cross sectional view of a unit fuel injector including the injector body attaching device of the present invention.

Referring to FIG. 1, there is shown the unit fuel injector of the present invention, indicated generally at 10, which includes a threadless injector body attaching device 12 which effectively minimizes transverse assembly loads on the injector body to thereby minimize injector bore distortion thus reducing plunger wear and avoiding injector failure. Unit fuel injector 10 generally includes an injector body 14 having a central bore 16, a top stop housing 18 mounted on the injector body 14 and a plunger assembly 20 mounted in central bore 16. Unit fuel injector 10 is preferably of the open nozzle type wherein plunger assembly 20 include an upper plunger 22, a timing plunger 24 and a lower plunger 26. The plunger assembly 20 is driven by an injector drive train (not shown) via a link 28 to force fuel from a chamber 30 through injection orifices 32 into the combustion chamber of an engine (not shown). Unit fuel injector 10 is secured to an engine, i.e. securely mounted in a mounting bore formed in an engine cylinder head, by a conventional clamping device, such as a clamp 34, capable of applying an axial mounting load to injector body 14.

Figure 3:
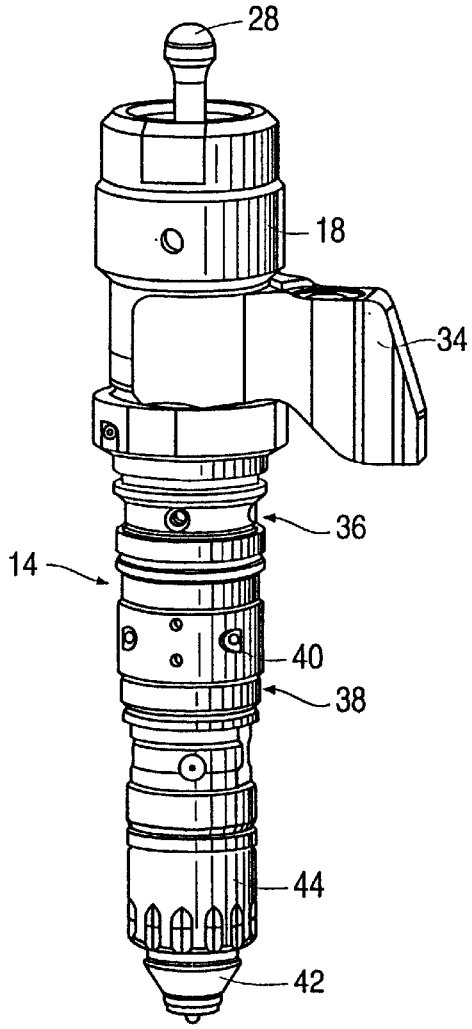
FIG. 3 is a perspective view of the unit fuel injector assembly of FIG. 1 including an injector mounting clamp.

As shown in FIG. 3, injector body 14 includes a barrel or upper body section 36 and a lower body section 38 attached to upper body section 36. Lower body section 38 includes a spring housing 40 attached to the lower end of upper body section 36 via threadless injector body attaching device 12, a nozzle housing 42 and a nozzle retainer 44 securing nozzle housing 42 to the lower end of spring housing 40. As shown in FIG. 1, central bore 16 extends through upper body section 36 and lower body section 38 for receiving reciprocally mounted plungers 22, 24 and 26. It should be noted that top stop housing 18 may be any conventional top stop capable of limiting the upward movement of upper plunger 22. However, top stop housing is preferably of the type shown in FIG. 1 and described in detail in co-pending application entitled "Top Stop Assembly for a Fuel Injector" which is commonly assigned to the assignee of the present application and the entire contents of which is hereby incorporated by reference.

A timing chamber 46 is formed between upper plunger 22 and timing plunger 24 for receiving timing fluid, i.e. fuel, via inlet ports or orifices 48 formed in upper body section 36. A precisely metered quantity of timing fluid enters timing chamber 46 to form a fluid link having a variable effect length primarily dependent on the supply pressure and, secondarily, on the total time that timing fluid flows through inlet ports 48. For any given set of conditions, the fluid link has a predetermined effective length corresponding to the desired injection timing. During the advancement stroke, the link is formed and fuel, metered into chamber 30 via a metering circuit (not shown) formed in the injector body, is discharged through injection orifices 32. The structure and operation of unit fuel injector 10 with respect to the timing and metering of fuel injection in the advancement and retraction strokes of the plunger assembly are described in more detail in co-pending patent application entitled "Fuel Injector with Isolated Spring Chamber", commonly assigned to the assignee of the present application, and the entire contents of which is hereby incorporated by reference. Although unit fuel injector 10 is disclosed as an open nozzle fuel injector, the threadless injector body attaching device 12 of the present invention may be incorporated into any fuel injector wherein transverse loads on the injector body should be minimized. For example, any injector having a central bore and a plunger reciprocally mounted in the central bore, such as a closed nozzle injector, would benefit from the present invention. Nozzle retainer 44 includes threads formed at an upper end for engaging complementary threads formed on a lower end of spring housing 40. Relative rotation of retainer 44 and spring housing 40 causes retainer 44 to pull spring housing 40 and nozzle housing 42 into compressive abutment against one another.

Figure 2:
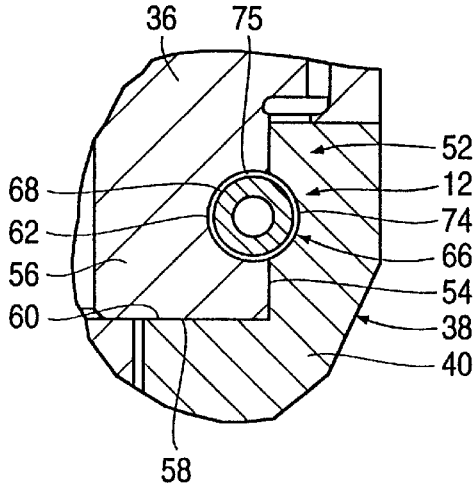
FIG. 2 is an enlarged cross sectional view of a portion of the unit fuel injector of FIG. 1 showing the details of the injector body attaching device of the present invention.
Figure 4:
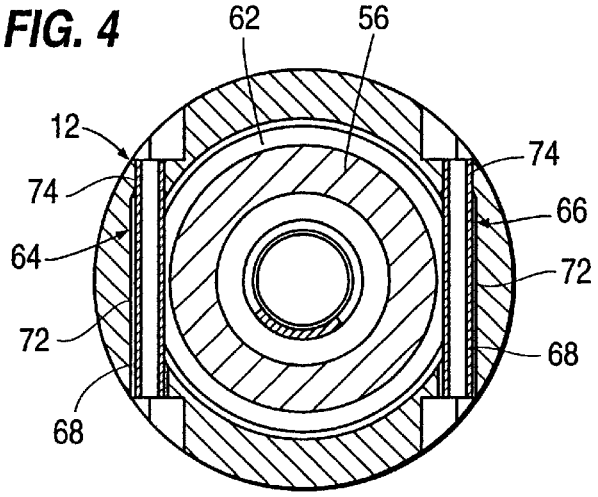
FIG. 4 is a cross sectional view of the fuel injector and injector body attaching device of the present invention taken along plane 4—4 in FIG. 2.
Figure 5:
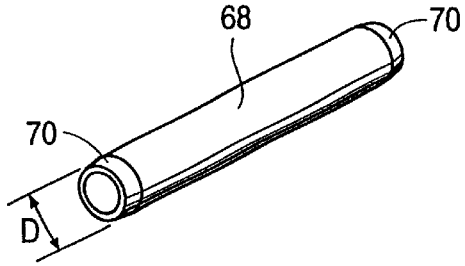
FIG. 5 is a perspective view of a pin of the injector body attaching device of the present invention.

As shown in FIG. 2, threadless injector body attaching device 12 is positioned at an interface 52 of upper body section 36 and lower body section 38. The outer end of lower body section 38 includes a recess 54 for receiving, and aligning, a lower end portion 56 of upper body section 36 which is sized to easily fit into the recess 54. A lower surface 58 formed on lower end portion 56 is positioned immediately adjacent an upper surface 60 formed on the outer end of spring housing 40 inside recess 54. Threadless injector body attaching device 12 includes an annular groove 62 formed in the outer surface of lower end portion 56 of upper body section 36 so as to be positioned in recess 54 when lower end portion 56 engages recess 54. As shown in FIG. 4, threadless injector body attaching device 12 further includes a first pin aperture 64 extending transversely through the upper portion of spring housing 40. In addition, a second pin aperture 66 also extends through the upper portion of spring housing 40 on an opposite side of the spring housing from first pin aperture 64. First and second pin aperture 64, 66 extend generally parallel to one another and are positioned tangential to both recess 54 and annular groove 62. Threadless injector body attaching device 12 further includes a pin 68 for each of the first and second pin apertures 64, 66. As best shown in FIG. 5, pin 68 is preferably a coiled roll pin design to permit easy assembly, however many other types of pins may be used, such as a solid pin. Each pin 68 preferably includes a camber surface 70 at each end for permitting easy alignment of the pin in first and second pin apertures 64 and 66.

Importantly, first and second pin apertures 64 and 66 each include a slip fit portion 72 extending a significant length of each aperture 64, 66 and a press fit portion 74 formed at one end of each slip fit portion 72. Slip fit portions 72 are formed with a diameter slightly larger than the diameter or width D of pin 68 to permit pin 68 to be easily inserted through slip fit portion 72. On the other hand, press fit portions 74 are formed with a diameter slightly less than the diameter D of pin 68 to create an interference, or press, fit between one end of pin 68 and the corresponding press fit portion. First and second pin aperture 64 and 66 also include counter bore portions formed at each end to simplify the manufacturing and assembly process. Also, preferably, a lead-in chamfer surface is used to transition from the slip fit portion to the press fit portion to aid in assembly.

Another important aspect of the present threadless injector body attaching device 12 is the. relative sizing of annular groove 62, apertures 64 and 66 and pin 68. In conventional fuel injector body designs, an upper body section is connected to the lower body section via a threaded connection which places transverse loads on the upper body section thereby distorting the central bore and causing plunger scuffing. The present threadless injector body attaching device 12 avoids placing transverse assembly loads on upper body section 36 by avoiding a threaded connection, sizing annular groove 62 and apertures 64 and 66 to form a cavity 75 having a peripheral extent greater than the diameter D of pin 68 and relying on the clamping load of clamp 34 to apply an axial sealing load to upper body section 36 necessary to create a fluid seal between lower surface 58 of upper body section 36 and upper surface 60 of lower body section 38. By relying solely on the mounting or clamping load applied by clamp 34 to also create the sealing load for sealed connection between upper body section 36 and lower body section 38, a simple, low cost threadless injector body attaching device can be used to create a relatively loose unsealed connection between upper body section 36 and lower body section 38 without the application of transverse loads caused by a threaded connection. It should be understood that the threadless injector body attaching device 12 of the present invention may use a single pin and aperture combination, or any other connection capable of attaching upper body section 36 and lower body section 38 while avoiding imparting a transverse load to upper body section 36. In addition, it should be noted that pin 68 and first and second pin aperture 64 and 66 may be formed with noncircular cross sections. Moreover, annular groove 62 may also be formed with a different cross sectional shape. Regardless of the cross sectional shape of the pins, apertures and groove in the present preferred embodiment, the transverse assembly loads at this connection are completely avoided by sizing cavity 75 with a diameter or peripheral extent large enough to avoid pressed contact with pin 68. Thus, each pin 68 can be easily inserted through first and second pin aperture 64, 66 and tangentially through annular groove 68 without imparting a transverse load to upper body 36.

During assembly, upper body section 36 is axially aligned with lower body section 38 and fully inserted into recess 54 to position annular groove 62 adjacent both first and second pin aperture 64 and 66. A respective pin 68 is then inserted into the end of first and second pin apertures 64 and 66 opposite press fit portion 74. Each pin 68 is then pushed through first and second pin aperture 64 and 66 until the inner ends of each pin 68 fully and securely engage press fit portion 74. During insertion of the pins, each pin 68 will engage annular groove 62 regardless of the relative rotative position between upper body section 36 and lower body section 38 since annular groove 62 extends around the entire circumference of lower end portion 56 of upper body section 36. Unit fuel injector 10 can then be easily handled, positioned on the engine and securely mounted to the engine by installing clamp 34. Importantly, clamp 34 applies a clamping load to unit fuel injector 10 which not only secures the fuel injector to the engine but creates a fluid seal between the outer surface of the injector body and the inner surface of, for example, a mounting bore formed in an engine cylinder head. In the present invention, the clamp or mounting load imparted by clamp 34 is also used as a sealing load to create an internal fluid seal between lower surface 58 of upper body section 36 and upper surface 60 of lower body section 38. Prior to the application of clamp 34, threadless injector body attaching device 12 merely creates a relatively loose connection between upper body section 36 and lower body section 38 which advantageously permits easy handling and mounting of the injector without the application of transverse loads to the injector body. Once clamp 34 is secured to unit fuel injector 10, the sealing load applied by clamp 34 is of a sufficient magnitude necessary to force upper surface 60 against lower surface 58 to create a fluid seal between the surfaces. Upon injector removal, clamp 34 is removed, and an injector removing tool is used to grasp the outer end of upper body section 36. A pulling force is then applied to the upper body section 36 by the injector removal tool. Consequently, threadless injector body attaching device 12 must be of sufficient strength to withstand the removal loads to ensure injector removal without the injector body attaching device failing even when an injector may be seized in the engine mounting bore. The present invention creates a sufficiently strong connection between upper body section 36 and lower body section 38 by using two pins instead of one. Importantly, the use of two pins also permits pins having a smaller diameter D thereby requiring an annular groove of minimal depth. By minimizing the depth of annular groove 62, the present two pin arrangement creates a more robust lower end portion 56 thereby further minimizing bore distortion. In addition, by positioning pins 68 and first and second pin apertures 64 and 66 symmetrically on opposite sides of injector body 14, injector removal loads are evenly distributed thereby possibly improving the ease with which injectors may be removed.

The present invention results in many advantages over the conventional injector having a threaded connection between upper and lower body sections or any other connection which imparts transverse loads to an injector body section. During operation, the unit fuel injector 10 of the present invention will experience no transverse loads due to the connection at interface 52 since threadless injector body attaching device 12 relatively loosely attaches upper body section 36 and lower body section 38 and clamp 34 merely applies an axial load to injector body 14. Therefore, the present invention greatly reduces bore distortion due to assembly and mounting loads by minimizing transverse loading thereby reducing plunger wear and minimizing the likelihood of plunger seizure/failure. In addition, the present threadless injector body attaching device provides a less costly solution to the transverse assembly loading problem than conventional injectors using a threaded connection. Some conventional injectors included an annular groove in the lower portion of the upper body section which created a thin walled section adjacent the threads on the upper body section to isolate distortion. However, the annular groove is expensive to manufacture and required an extra component (a washer) adjacent the annular groove to prevent damage to other portions of the injector assembly. The present threadless injector body attaching device is simple and less expensive to manufacture, easy to assemble and more effective in reducing injector bore distortion.

INDUSTRIAL APPLICABILITY

The threadless injector body attaching device of the present invention may be used on any fuel injector having a reciprocally mounted plunger assembly, i.e. a mechanically or hydraulically actuated unit fuel injector, mounted on any combustion engine of any vehicle or industrial equipment in which increased injector reliability is beneficial.

We claim:

1. A unit fuel injector for injecting fuel into the combustion chamber of an internal combustion engine, comprising:

an injector body including an upper body section, a central bore formed in said upper body section, a lower body section and an injection orifice formed in one end of said injector body to discharge fuel into the combustion chamber;

a plunger means mounted in said central bore for reciprocal movement through advancement and retraction strokes; and a threadless injector body attaching means positioned at an interface between said upper body section and said lower body section for attaching said upper body section to said lower body section while avoiding imparting a transverse load to said upper body section, wherein said threadless injector body attaching means includes a groove formed in one of said upper body section and said lower body section, and at least one pin positioned in said groove, said groove at least partially forming a cavity having a peripheral extent and said at least one pin includes a width less than said cavity peripheral extent to create a slip fit between said groove and said at least one pin permitting slight relative axial movement between said upper body section and said lower body section.

2. The unit fuel injector of claim 1, wherein said threadless injector body attaching means is positioned along a longitudinal axis of the injector body radially adjacent said central bore.

3. The unit fuel injector of claim 1, wherein said threadless injector body attaching means is positioned at said interface on at least two opposite sides of said injector body.

4. The unit fuel injector of claim 1, wherein said threadless injector body attaching means includes a pin aperture formed in one of said upper body section and said lower body section, and a pin positioned in said pin aperture.

5. The unit fuel injector of claim 1, wherein said groove is an annular groove extending around one of said upper body section and said lower body section.

6. The unit fuel injector of claim 5, wherein said annular groove is formed in an outer surface of said upper body section.

7. The unit fuel injector of claim 6, wherein said lower body section includes a recess formed in one end for receiving a lower end of said upper body section, said annular groove being positioned in said recess.

8. The unit fuel injector of claim 1, wherein said threadless injector body attaching means further includes at least one pin aperture formed in one of said upper body section and said lower body section.

9. The unit fuel injector of claim 8, wherein said at least one pin aperture is formed in said lower body section and positioned tangential to said annular groove.

10. The unit fuel injector of claim 9, wherein said at least one pin aperture includes a first pin aperture formed in one side of said lower body section and a second pin aperture formed on an opposite side of said lower body section, said at least one pin including a first pin positioned in said first pin aperture and a second pin positioned in said second pin aperture.

11. A unit fuel injector for injecting fuel into the combustion chamber of an internal combustion engine, comprising:

an injector body including an upper body section, a central bore formed in said upper body section, a lower body section and an injection orifice formed in one end of said lower body section to discharge fuel into the combustion chamber;

a plunger means mounted in said central bore for reciprocal movement through advancement and retraction strokes; and an injector body attaching means positioned along said longitudinal axis of said injector body radially adjacent said central bore for attaching said lower body section to said upper body section, said injector body attaching means including at least one transverse aperture formed in one of said upper body section and said lower body section and at least one pin positioned in said transverse aperture, wherein said injector body attaching means includes a groove formed in one of said upper body section and said lower body section for engagement by said at least one pin, said groove at least partially forming a cavity having a peripheral extent and said at least one pin includes a width less than said cavity peripheral extent to create a slip fit between said groove and said at least one pin.

12. The unit fuel injector of claim 11, wherein said groove is an annular groove extending around one of said upper body section and said lower body section.

13. The unit fuel injector of claim 12, wherein said annular groove is formed in an outer surface of said upper body section, said lower body section including a recess formed in one end for receiving a lower end of said upper body section, said annular groove being positioned in said recess.

14. The unit fuel injector of claim 12, wherein said at least one transverse aperture is formed in said lower body section and positioned tangential to said annular groove.

15. The unit fuel injector of claim 14, wherein said at least one pin aperture includes a first pin aperture formed in one side of said lower body section and a second pin aperture formed on an opposite side of said lower body section, said at least one pin including a first pin positioned in said first pin aperture and a second pin positioned in said second pin aperture.

* * * * *